United States Patent [19]

Cohen, deceased et al.

[11] Patent Number: 4,576,336

[45] Date of Patent: Mar. 18, 1986

[54] DRINKING STRAW

[76] Inventors: Nathan Cohen, deceased, late of Jamaica, N.Y.; Mary Cohen, executrix, 147-57 Village Rd., Jamaica, N.Y. 11435

[21] Appl. No.: 594,996

[22] Filed: Mar. 29, 1984

[51] Int. Cl.[4] ..... A47G 21/18

[52] U.S. Cl. ..... 239/33; 215/1 A

[58] Field of Search ..... 239/33; 215/1 A, 229; 229/75; 220/90.2

[56] References Cited

U.S. PATENT DOCUMENTS 2,070,495 2/1937 Strutz et al. ..... 215/100 R 3,606,156 9/1971 Homorodean et al. ..... 239/33

*Primary Examiner*—Andres Kashnikow

*Assistant Examiner*—Scott Malpede

*Attorney, Agent, or Firm*—Bauer & Amer

[57] ABSTRACT

A drinking straw in which the hollow tube has inlet and outlet ends that are coextensive with an engagement that engage walls of a drinking vessel to hold the straw and the vessel together and in which the an engagement includes turns which are a continuation of the tube and form an integral part of the flow path of the drinking straw.

14 Claims, 2 Drawing Figures

DRINKING STRAW

The present invention is directed to a drinking straw for use with a drinking vessel as a drinking cup, glass, dish and the like. More particularly, the drinking straw of the present invention provides an incentive for children, invalids and others to consume liquids while the straw and drinking vessel are held connected together and against accidental separation.

BACKGROUND OF THE INVENTION

Drinking straws are commonly used by children, invalids and incapacitated individuals as an inducement and an incentive to them to consume nourishing liquids. To this end straws of decorative designs have been employed along with straws of unusually attractive contours so that the user may follow the flow path of the liquid along the length of the straw and be encouraged to use the straw to drink the liquids. In this respect, attention is drawn to the patents to Kamin U.S. Pat. No. Des. 262,176, to Homorodean et al. U.S. Pat. Nos. 3,606,156 and to Dietz et al. 3,425,626.

It is well known that children, invalids, incapacitated persons and others experience difficulty in retaining the straw in the drinking vessel or in holding the straw engaged with the drinking vessel while the straw is being used to withdraw liquid from the vessel. The failure of the straw and the vessel to remain engaged with each other or to remain clipped, clasped, or clamped together during use and manipulation has been a problem that has been treated in many prior art patents as follows:

Shapin—U.S. Pat. No. 103,300
Howard—U.S. Pat. No. 478,861
Tanner—U.S. Pat. No. 1,735,144
Gildersleeve—U.S. Pat. No. 2,063,803
Strutz et al.—U.S. Pat. No. 2,070,495
Cornwell—U.S. Pat. No. 2,469,292
Butsch—U.S. Pat. No. 2,557,411
Saltzman—U.S. Pat. No. 2,689,149.

SUMMARY OF THE INVENTION

The present invention provides a drinking straw that treats and overcomes the problem sought to be solved but never fully attained by the prior art. The aforedescribed prior art discusses the need for means to retain the straw and vessel connected together. They variously describe engaging means in the form of clips, clasps, clamps and other constructions, all of which are here deemed to be the same for the purpose of understanding the scope of the present invention. In each such prior art disclosure the engaging means employed is an element or complex structure that is an entity completely separate and distinct from the drinking straw itself. Hence, the engaging means and the drinking straw are required to be joined together with each continuing to function aggregatively as separate and distinct elements to perform their individual functions in spite of the fact that they may be joined together.

The present drinking straw is a uniquely different approach to the resolution of the problems experienced by the prior art. It provides a singular, unitary structure in which the drinking straw itself is formed with engaging portions that engage the walls of the drinking vessel to hold and retain the vessel and straw together against accidental displacement, even during rough manipulation of the same.

The engaging means of the present drinking straw are continuous coextensions that, in addition to their clipping, clasping and clamping function, also enables the user to view the fascinating passage and flow of the liquid from the vessel along interesting turns and decorative contours with which the straw may be provided.

The above description, as well as further objects, features and advantages of the present invention, will be more fully appreciated by reference to the following detailed description of a presently preferred, but nonetheless illustrative, embodiment in accordance with the present invention when taken in conjunction with the accompanying drawing wherein:

DESCRIPTION OF THE INVENTION

Figure 1:
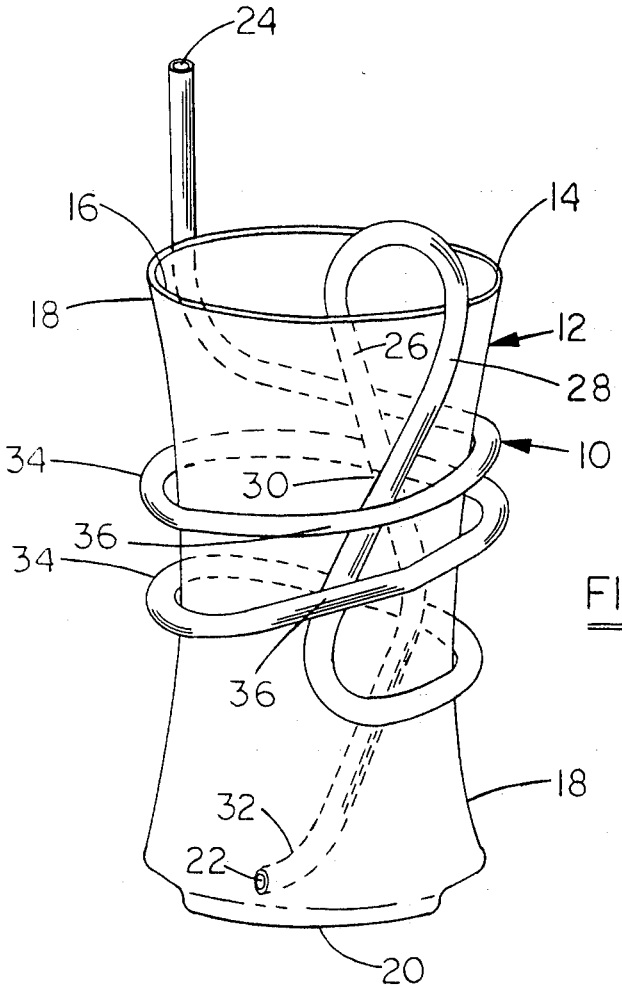
FIG. 1 is a perspective view of a drinking straw constructed according to the teaching of the invention positioned within a transparent drinking vessel.

Referring to the drawing, the drinking straw thereshown is generally identified by the numeral 10 and is shown positioned within a drinking vessel generally identified by the numeral 12. The vessel 12 is shown in the form of a conventional transparent drinking glass so as to enable an illustration of the details of the invention by seeing through the wall thereof. The illustration of the drinking vessel should not be treated as or deemed to be a limitation upon the scope of the invention. Those skilled in this art will readily recognize that the drinking straw 10 may be used with any other form of drinking or liquid containing vessel from which fluid may be siphoned. It may merely be necessary to adapt the straw 10 to such vessel without departing from the teaching of the invention.

Assuming that such liquid containing drinking vessels 12 are provided with one or more side walls, such as the circular wall 14, it will be recognized that the same must have some thickness. Therefore, the wall 14 has at least an inner wall surface 16 and an outer wall surface 18 which project downward and merge with the vessel bottom 20. Once again, it is noted that the specific details of the vessel 12 are not important to the operation of the present invention and, therefore, form no part of the same. However, it is hoped this brief description of the drinking vessel will be helpful in understanding the use and operation of the present invention.

The drinking straw 10 is generally formed as a hollow monolithic tube. In the manufacture of the straw 10, the same may be made of a single body of material that may be continuous and coextensive throughout its length so that the hollow tube will provide an uninterrupted path for the flow of liquid therealong from its inlet end 22 to its outlet end 24. The tube provides the siphon path along which the liquid in a vessel 12 may be withdrawn to the outlet or exhaust end 24 where it is then drunk and ingested by the user.

The straw 10 may be constructed of any desired material. In practice, plastic has been found to be convenient and practical because it can be extruded in continuous and desired lengths which may be cut or chopped into smaller lengths sufficient to form the straw with whatever designs and/or contours may be desired. Although not restrictive upon the invention, the straw may be of transparent material to enable the user to watch and to be enthralled by seeing the passage of the liquid along the flow path of the tube from the inlet end 22 to the outlet end 24.

The body of the straw is provided with an engagement means or structure having at least two turns 26 and 28 intermediate the inlet and outlet ends 22 and 24. As the description proceeds, it will become clear that such turns may be increased in number without departing from the teaching of the invention. For the convenience of description only, the turn 26 may be stated to be the inside turn while the other turn 28 may be denominated as the outside turn. The turns 26 and 28 are arranged opposed to each other with the turn 26 adapted to extend along and engage with the inner wall surface 16 and the outer turn 28 is adapted to extend along and engage with the outer wall surface 18. Each turn 26 and 28 is adapted to make at least point engagement with its respective wall surfaces 16 and 18. In the illustration of FIG. 1, the walls of the vessel 12 are shown curved. However, when the walls 16 and 18 are more generally straight sided, the surfaces of the turns 26 and 28 will make longer surface to surface engagement with the respective wall surfaces 16 and 18.

The turns 26 and 28 are shown oppositely angled to each other to cross each other as at 30. Because they are in opposed and oppositely angled relationship, they are normally in touching engagement with each other at the point 30 where they cross each other. This means that anything that is inserted between the opposed oppositely angled touching surfaces of the turns 26 and 28 must first spread them apart before entering between the surfaces and in so doing the walls of the article inserted between the surfaces 26 and 28 will, in turn, have their surfaces pressed into surface-to-surface engagement with the facing surfaces of the turns 26 and 28.

When so engaged between the surfaces of the turns 26 and 28, the engaging walls of the vessel 12 or other article are then tightly gripped between the surfaces of the turns and more especially at the cross point 30 of the surfaces of the turns 26 and 28. In the illustration in FIGS. 1 and 2, it will be seen that the inner and outer walls 16 and 18 of the glass are in snug surface-to-surface engagement with the respective facing engaging surfaces of the respective turns 26 and 28. Hence, the wall surfaces 16 and 18 are held by the engaging surfaces of the turns 26 and 28 and more especially more tightly at the crossing point 30 of such turns.

The crossing at 30 of the relatively angled turns 26 and 28 that touch each other at the point of crossing 30 produce a holding engagement with the vessel walls analogous to that of a clip or a clasp or a clamp, except that in the present drinking straw 10 the engaging structure, comprising the terms 26 and 28, is a continuous and coextensive working portion of the monolithic straw body through which the liquid moves along its flow path. It is to be noted that the opposed surfaces of the turns 26 and 28 afford an elongated length of contact and holding engagement with the walls of the vessel that is positioned between them to ensure a secure grip therewith. As noted above, the straighter that the walls 16 and 18 are the longer and more complete will be the extent. and length of surface-to-surface contact between such vessel walls and the turns 26 and 28 of the engaging structure of the straw.

The length and angle or curve 32 provided at the inlet end of the straw 10 is a matter of choice and may be varied as desired to assure its projection and reach into the lowermost portion of the vessel 12 to enable it to withdraw all the liquid from the vessel. The exit or outlet end 24 of the straw also may be arranged in any desired and comfortable angular relation with respect to the vessel 12 to which it is attached. Hence, the specific angles or curves of the inlet and outlet ends 22 and 24 respectively of the straw as shown are not intended to be limitations upon the invention but are intended to be mere illustrations which suggest the possibility of the use of any other desired configurations.

The body portion of the straw 10 is provided with a series of helical turns 34 which may be of any desired shape and number. It has been found in practice that by providing the turns 34 either on the inside or on the outside of the drinking vessel 12, the interest of the user is immensely increased. The helix configuration provides a flow path for the liquid therethrough that fascinates and holds the attention of young and old users who watch the liquid as it traverses and flows therealong.

It is desirable to position the turns 34 of the helix so it is proximate and substantially coincident with the contour of either the inner or the outer walls, or both, of the vessel 12. The helix turns 34 may be substantially regular or irregular in their curvature as they conform substantially to the configuration of one or both walls of the vessel 12. For convenience, the illustration in the drawing shows the helical turns 34 positioned adjacent to and about the outer wall 18 of the vessel to enable a clearer view and understanding of their additional details of structure.

It will be seen that because the coils or turns 34 of the helix are circumposed about the outer wall 18, they also wrap about the turn 26 of the engagement structure of the straw 10. Advantage is taken of this helical wrap to position more closely the helical turns about the turn 28 so that a portion of the length of the turns 34 can have their surfaces in adjacent surface-to-surface cross-over relationship with the turn 28.

Figure 2:
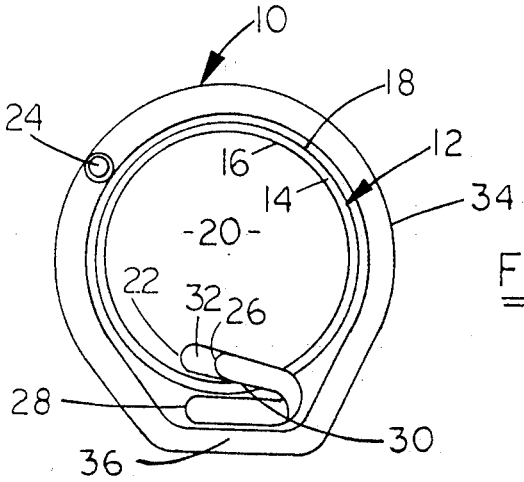
FIG. 2 is a top view of FIG. 1.

For example, as will be seen from FIGS. 1 and 2, the lengthwise portion 36 of each of the helical turns 34 is shown slightly flattened or shaped almost in a straight line where they cross over the engagement turn 28. The portions 36 are also shown positioned as close as possible to the adjacent surface of the turn 28, either in surface-to-surface engagement therewith or slightly spaced outward therefrom so as to provide an abutment or limiting wall for the outward side of the turn 28 which will limit the outward movement of such turn when the thickness of a drinking vessel wall 14 is inserted between the turns 26 and 28.

Thus, in practice the portion or portions 36 is or are positioned adjacent to the turn 28 to limit and restrict its outward disengagement movement against accidental displacement and to inhibit the disengagement of the turn 28 from the adjacent wall 18 of the drinking vessel 12. Although both helical turns 34 are shown to be provided with the limiting portions 36, the limitation upon the disengaging movement of the turn 28 can be effective when only one such turn 34 is provided with the limiting surface portion 36.

Those who are skilled in this art will readily see that one or more turns 34 also may be provided within the vessel 12 so as to engage or come close to engagement with the outer surface of the turn 26. In like manner, the turn 34 that may be adjacent to the outer surface of the turn 26 on the inside of the drinking vessel 12 will inhibit and limit the inward movement of the turn 26 upon the insertion between or the removal from between the turns 26 and 28 of a drinking vessel wall.

The drinking straw 10 and the vessel 12 are assembled by relatively moving the wall 14 of the vessel 12 and the turns 26 and 28 of the straw toward each other. Initially, the open top of the vessel 12 is aligned so as to enter within the outer encompassing helical turns 34 so that its wall 14 will automatically be located to enter between the legs of the turns 26 and 28 of the engagement structure. As the wall 14 enters between the turns 26 and 28, it deflects the turn 26 inward and the turn 28 outward out of and away from engagement with each other. In the illustration shown in FIGS. 1 and 2, the inner turn 26 will slide along in engagement with the inner wall surface 16 as the drinking vessel and straw are moved to total assembly. Consequently, the outer turn 28 of the engaging means also will engage with and slide along in frictional gripping engagement with the outer wall 18 of the drinking vessel. During its outward movement, the outer turn 28 will come into contact with the abutment or inhibiting portion 36 of the turns 34.

When the straw 10 and vessel 12 are assembled as shown, the same will be engaged and remain engaged and assembled together against accidental separation. When so gripped in their engaged and assembled relationship, the engagement structure permits the user to lift and manipulate the straw and/or the vessel without fear of their separation. Naturally, the straw 10 may be used in its normal manner with the liquid drawn by the user from the vessel at the inlet end 22 toward the outlet end 24, along its engaging structure and along its helical turns. By reason of its singular, monolithic construction the user's attention is attracted to the turns 26, 28 and 34 and can watch the passage and flow of the liquid from the vessel to the outlet end 24.

The straw 10 and vessel 12 are easily disassembled simply by reversing the assembly movements previously described. As the two are moved in opposite directions away from each other, the turn 26 will move inward once again and will frictionally slide along and off of the inner wall surface 16 of the vessel. Because the inner surface 26, as illustrated in the drawing, is not restricted in its inward flexing and deflecting movement, the friction with which it engages the inner wall surface 16 is much less than that which is applied to the outer wall surface 18 by the engaging surface of the turn 28. The relative engagement between the surface of the turn 28 with the outer surface 18 of the vessel is increased during the separating movement by reason of the limitation placed upon the flexing and deflecting outward movement of the turn 28 by the portions 36 with which it is pressed into engagement.

As a consequence, in order to complete the disassembly to release the engaging structure from its hold with the opposite wall surfaces 16 and 18, it is necessary to apply a slightly greater separating force to both the straw and the vessel to force the inner turn 26 to flex inward a distance slightly greater than the movement permitted to the outer turn 28. The limiting or abutment portions 36 may be eliminated completely when the relative angular relationship between the turns 26 and 28 is reduced closer to zero.

The closer the angular separation between the turns 26 and 28 is toward zero and the more the turns are arranged in vertical alignment with each other, the greater will be the length of frictional engagement between the inner surfaces of the turns 26 and 28 with the adjacent wall surfaces of the vessel 16. Naturally, if the space between the surfaces 26 and 28 is completely eliminated at the point of contact 30 and if such surfaces of the turns are in tight engagement along a fuller extent of their lengths at such point of contact, then the extent of frictional engagement between such surfaces of the engaging structure of the straw with the respective walls of the vessel will be so substantially increased as to eliminate the use of the inhibiting abutment limiting portions 36.

While there have been shown and described and pointed out the fundamental novel features of the invention as applied to a preferred embodiment thereof, it will be understood that various omissions and substitutions and changes in the form and details of the device illustrated and in its operation may be made by those skilled in the art without departing from the spirit of the invention. It is the intention, therefore, to be limited only as indicated by the scope of the claims appended hereto.

What is claimed is:

1. A drinking straw for use with a drinking vessel, said straw comprising a hollow tube having a continuous fluid flow path between inlet and exhaust ends, and a plurality of turns intermediate said ends and interconnecting said ends into a unitary straw having a fluid path of singular uninterrupted construction in which certain of said intermediate turns cross each other to engage therebetween and with the inner and outer walls of a drinking vessel to grip the walls of the drinking vessel theretween to retain the straw connected with the drinking vessel.

2. A drinking straw as in claim 1, said intermediate turns being relatively movable to release their grip with the walls of the drinking vessel to permit the straw to be disengaged from the drinking vessel.

3. A drinking straw as in claim 2, said turns and inlet and outlet ends being formed monolithic.

4. A drinking straw as in claim 2, said straw including at least certain of said turns being formed with a helix conforming substantially to a wall of the drinking vessel.

5. A drinking straw for use with a drinking vessel, said straw comprising a hollow tube having inlet and exhaust ends, and a plurality of turns intermediate said ends and interconnecting said ends into a unitary straw of singular uninterrupted construction in which certain of said turns engage at the same time both with the inner and outer walls of a drinking vessel to grip the walls of the drinking vessel therebetween to retain the straw connected with the drinking vessel, said intermediate turns being relatively movable to release their grip with the walls of the drinking vessel to permit the straw to be disengaged from the drinking vessel, said straw including at least certain of said turns being formed with a helix conforming substantially to a wall of the drinking vessel, at least a portion of a helix turn being engageable with another of said turns to limit the movement thereof from accidental disengagement with a respective wall of a drinking vessel with which the same is engaged.

6. A drinking straw comprising an inlet for positioning within a vessel for the removal of the contents therefrom, said straw comprising a continuous hollow tube having an outlet to be positioned external to the vessel for applying a suction thereat to said straw which suction is transmitted through the hollow tube of said straw to said inlet, and said hollow tube having vessel engaging turns formed intermediate said inlet and outlet and monolithic and coextensive therewith to provide a continuous fluid flow path along which the fluid contents of the vessel flow while being removed from the vessel and said engaging turns engaging both the inner and outer walls of the vessel at the same time to engage and hold said straw and vessel together with said inlet positioned within the vessel and being movable to disengage from the vessel walls to separate the straw and vessel from each other.

7. A drinking straw as in claim 6, said engaging means including opposed turns of said straw one turn of which is inside the vessel and the other turn of which is outside the vessel to engage with respective inner and outer side walls of the vessel at the same time to retain the vessel and said straw together and to resist the accidental separation of said straw from the vessel.

8. A drinking straw as in claim 6, said straw having a body formed with at least one helical turn conforming substantially adjacent to a wall of the vessel, said body being intermediate said inlet and outlet and being formed monolithic therewith.

9. A drinking straw comprising an inlet for positioning within a vessel for the removal of the contents therefrom, said straw comprising a hollow tube having an outlet to be positioned external to the vessel for applying a suction thereat to said straw which suction is transmitted through the hollow tube of said straw to said inlet, and said tube having vessel engaging means formed intermediate said inlet and outlet monolithic and coextensive therewith to provide a path along which the contents of the vessel flow while being removed from the vessel and engaging both the inner and outer walls of the vessel at the same time to hold said straw and vessel together with said inlet positioned within the vessel, said engaging means including opposed turns of said straw one turn of which is inside the vessel and the other turn of which is outside the vessel to engage with respective side walls of the vessel at the same time to retain the vessel and said straw together and to resist the accidental separation of said straw from the vessel, another turn being formed in said straw as a monolithic part thereof and having a portion thereof engageable with one of said turns of said engaging means to restrict movement of the same from disengagement from the respective wall of the vessel.

10. A drinking straw as in claim 9, a helical turn being disposed adjacent a wall of the vessel and having an engageable portion engaging with a turn of said engaging means to restrict said engaged turn from disengagement from the outside wall of the vessel.

11. A drinking straw as in claim 10, said helical turn being disposed about the exterior wall of the vessel and to engage and restrict said turn of said engaging means engaged with the outside wall of the vessel from disengagement therefrom.

12. The method of connecting a drinking straw with a vessel comprising:

forming a straw substantially monolithic with a hollow continuous interior such that the inlet end and the outlet ends of the straw are connected together by a coextensive intermediate portion along which the contents of a vessel may flow without interruption from the inlet end to the outlet end, and providing the intermediate portion of the straw with a turn in a direction to extend into the vessel and with another turn in a direction to extend into the vessel and with another turn in a direction opposed to and crossing the first turn and adjacent thereto to form vessel engaging means therewith for engaging at the same time the inside and outside walls of a vessel inserted between the turns to engage and hold the straw to the engaged walls of the vessel.

13. The method connecting a drinking straw with a vessel comprising:

forming a straw substantially monolithic with a hollow continuous interior such that the inlet end and the outlet ends of the straw are connected together by a coextensive intermediate portion along which the contents of a vessel may flow from the inlet end of the outlet end, and providing the straw intermediate its ends with a turn in a direction to extend into the vessel and with another turn in a direction opposed to the first turn and adjacent thereto to form an engaging means therewith for engaging the inside and outside walls of a vessel inserted between the turns to engage and hold the straw to the walls of the vessel, providing the coextensive intermediate portion with another turn that engages with one of the turns of the engaging means to restrict its disengagement from the respective wall of the vessel so as to retain the straw in engagement with the vessel walls.

14. The method connecting a drinking straw with a vessel comprising forming a straw substantially monolithic with a hollow continuous interior such that the inlet end and the outlet ends of the straw are connected together by a coextensive intermediate portion along which the contents of a vessel may flow from the inlet end of the outlet end, and providing the straw intermediate its ends with a turn in a direction to extend into the vessel and with another turn in a direction opposed to the first turn and adjacent thereto to form an engaging means therewith for engaging the inside and outside walls of a vessel inserted between the turns to engage and hold the straw to the walls of the vessel, positioning the intermediate turns of the straw in opposed and angularly directed crossing relationship and with the intermediate turns being closely positioned relative to each other at their crossing by a distance less than the thickness of the wall of a vessel to be located therebetween for holding engagement with the turns thereat.

* * * * *